United States Patent [19]

Janke et al.

[11] Patent Number: 4,924,680

[45] Date of Patent: May 15, 1990

[54] REFRIGERATOR TEMPERATURE RESPONSIVE AIR OUTLET BAFFLE

[75] Inventors: Donald E. Janke, Benton Township, Berrien County; Edwin H. Frohbieter, Lincoln Township, Berrien County, both of Mich.

[73] Assignee: Whirlpool Corporation, Benton Harbor, Mich.

[21] Appl. No.: 221,038

[22] Filed: Jul. 18, 1988

[51] Int. Cl.[5] ..... F25D 17/06

[52] U.S. Cl. ..... 62/187; 62/407

[58] Field of Search ..... 62/187, 186, 408, 407, 62/413, 418

[56] References Cited

U.S. PATENT DOCUMENTS

| | | | |
|---|---|---|---|
| 3,096,629 | 7/1963 | Rembold | 62/407 X |
| 3,149,293 | 9/1964 | Farkas | 236/46 F |
| 3,164,970 | 1/1965 | Hubacker | 62/187 |
| 3,590,594 | 7/1971 | Arend | 62/187 |
| 3,834,177 | 9/1974 | Scarlett | 62/288 |
| 4,122,687 | 10/1978 | McKee | 62/187 X |
| 4,282,720 | 8/1981 | Stottmann et al. | 62/180 |
| 4,308,567 | 12/1981 | Mark | 361/187 |
| 4,409,639 | 10/1983 | Wesner | 361/167 |
| 4,450,897 | 5/1984 | Iijima et al. | 165/2 |
| 4,682,474 | 7/1987 | Janke | 62/187 |
| 4,688,393 | 8/1987 | Linstromberg et al. | 62/187 |
| 4,732,010 | 3/1988 | Linstromberg et al. | 62/187 |

FOREIGN PATENT DOCUMENTS 1228139 10/1987 Canada .

*Primary Examiner*—Harry B. Tanner

*Attorney, Agent, or Firm*—Wood, Phillips, Mason, Recktenwald & VanSanten

[57] ABSTRACT

An air circulation system for a refrigeration apparatus provides a controllable baffle to selectively open or close an air outlet port. Particularly, the refrigeration apparatus includes an evaporator and an evaporator fan for providing flow of refrigerated air. A fresh food compartment is to be cooled by the refrigerated air. An air inlet passage is provided in communication with the fan and compartment for delivering refrigerated air to the compartment. An air outlet passage is provided in communication with the compartment and the fan for returning air from the compartment to the fan. A baffle is mounted at the compartment air outlet and has an open position allowing movement of air through the compartment, and a closed position preventing movement of air through the compartment. A control is provided for selectively opening the baffle in response to the compartment temperature being above a desired temperature, and to close the baffle when the compartment temperature is below the desired temperature.

16 Claims, 1 Drawing Sheet

REFRIGERATOR TEMPERATURE RESPONSIVE AIR OUTLET BAFFLE

BACKGROUND OF THE INVENTION

1. Field of the Invention

This invention relates generally to refrigerator air circulation systems, and more particularly, an improved air circulation system for controlling an air outlet baffle.

2. Description of Background Art

Conventional dual compartment refrigerators of the forced air circulation type utilize a single evaporator and an evaporator fan for cooling a freezer compartment thereof. The freezer compartment is coupled by means of inlet and outlet passages through a divider wall to a fresh food compartment. A controllable baffle has been located within the fresh food compartment air inlet passage, which is operated by a control circuit to control the passage of refrigerated air into the fresh food compartment. Such an arrangement is shown in Janke, U.S. Pat. No. 4,682,474, assigned to the assignee of the present invention.

With such a conventional refrigerator, when the refrigeration unit is operating the evaporator fan forces air flow across the evaporator coils and out the top freezer into a scoop which directs air to the fresh food compartment, past the baffle. The fan flow overcomes natural convective flow caused by air density difference. Resultantly, with the fan on, air enters at the top, circulating within the fresh food compartment, and returns out of the bottom, back to the freezer.

During a conventional automatic defrost cycle, moisture can accumulate on the baffle. Once the defrost cycle is complete, the subsequent unit cycle time is of greater length since the cabinet must overcome the heat produced by the defrost heater. The colder air from the evaporator coils can cause moisture on the baffle to freeze. The resulting ice prevents free movement of the baffle resulting in over-cooling of the fresh food compartment.

Additionally, when the evaporator fan is off, air flow is controlled by natural convection. The colder and denser freezer air flows from the freezer bottom in a reverse direction through the compartment air outlet into the bottom of the fresh food compartment. With high ambient temperatures, where unit off time is short, such periods of uncontrolled back flow are short in duration so that performance is not hampered. However, with lower ambient temperatures, unit off time tends to be greater in duration resulting in the periods of uncontrolled back flow being longer. These long periods of back flow can result in the bottom portion of the fresh food compartment being overcooled causing freezing of articles therein.

The present invention overcomes the above problems with prior refrigerator air circulation systems, in a novel and simple manner.

SUMMARY OF THE INVENTION

In accordance with the present invention, a refrigeration apparatus is provided with a controllable baffle at the fresh food compartment air outlet to minimize freezing up of the baffle.

Broadly, there is disclosed herein a refrigeration apparatus including a compartment to be cooled by refrigerated air, inlet means for delivering refrigerated air to the compartment, outlet means for returning refrigerated air from the compartment and means for controlling the circulation of refrigerated air through said compartment by selectively opening or closing said air outlet means.

The refrigeration apparatus according to the invention includes a freezer compartment and a fresh food compartment. The freezer compartment houses an evaporator and an evaporator fan which draws air across the evaporator to provide refrigerated air. A divider wall separates the freezer compartment from the fresh food compartment and includes a first passage providing delivery of refrigerated air from the fan to the fresh food compartment at an inlet located at the top thereof. A second passage is provided for returning air from the fresh food compartment to the freezer and includes an air outlet located at the bottom of the fresh food compartment. Associated with the air outlet is a baffle, the baffle having closed and open positions. A control is operable to move the baffle between the open and closed positions to respectively allow or prevent movement of air through the compartment.

In the preferred embodiment, a control circuit controls energization of solenoid coils for moving the baffle between the open and closed positions. Temperature sensing means are provided for developing a signal representing temperature in the fresh food compartment. A set point means is provided for developing a signal representing a desired temperature in the compartment. The control circuit is responsive to the sensed temperature and the desired temperature to selectively energize the coils and move the baffle between the open and closed positions.

It is another feature of the present invention to provide the temperature sensing means positioned in the bottom portion of the fresh food compartment to sense temperature of such portion. Accordingly, in a unit off state, if a relatively cold temperature is sensed in the bottom portion of the refrigerator, then the control circuit is operable to move the baffle to the closed position to prevent back flow of refrigerated air from the freezer compartment into the bottom portion of the fresh food compartment.

It is another feature of the present invention to provide a second air inlet associated with the first air passage located at the bottom section of the refrigeration apparatus to provide for direct cooling at the bottom section of the refrigerator to provide a more desirably cool temperature at the bottom section of the refrigerator which might house, for example, a meat storage pan.

It is still another feature of the present invention to provide a plurality of air inlets associated with the first passage at selective vertical positions in fresh food compartment to provide a more direct cooling in any one of a plurality of different zones.

Further features and advantages of the invention will readily be apparent from the specification and the drawings.

DETAILED DESCRIPTION OF THE PREFERRED EMBODIMENT

Figure 1:
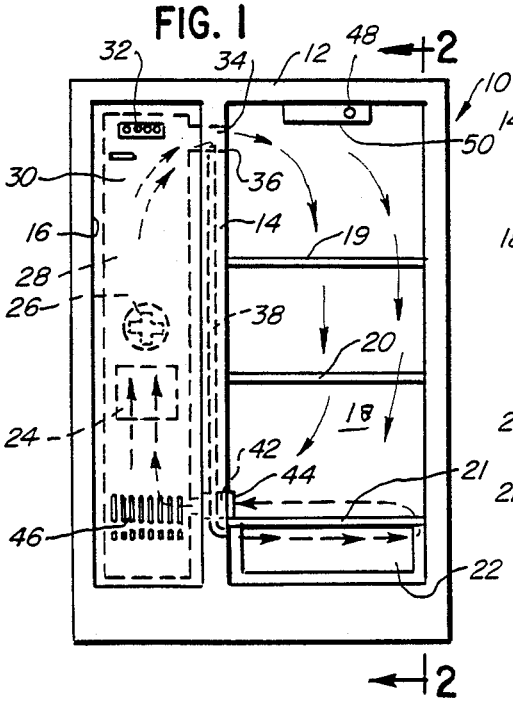
FIG. 1 is a front elevational view of a refrigerator having an air circulation system embodying the invention, the compartment doors being omitted to facilitate illustration of the components therein.
Figure 2:
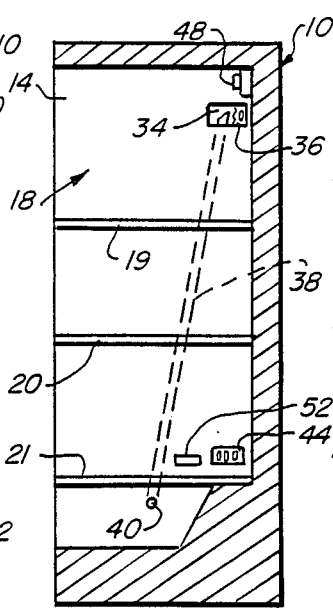
FIG. 2 is a sectional view taken along the lines 2—2 FIG. 1, with the storage pan removed.

Referring to FIGS. 1 and 2, a refrigeration apparatus, such as a refrigerator/freezer 10, includes an air circulation system according to the present invention. The invention is shown utilized with a side-by-side refrigerator/freezer. However, other types of refrigeration apparatus may be used in conjunction with the air circulation system of the present invention, as will be obvious to those skilled in the art.

The refrigerator/freezer 10 includes a cabinet 12 provided with an insulating separator, or divider wall, 14 defining a below-freezing, or freezer, compartment 16 and a fresh food, or above-freezing, compartment 18. Suitable doors (not shown) are provided for selective access to the freezer and fresh food compartments 16 and 18. Provided in the fresh food compartment 18 are plurality of shelves 19–21, each of the shelves being mounted therein in a conventional manner. A storage pan 22, such as a meat pan, is slidably mounted in a bottom section of the fresh food compartment 18 below the lower shelf 21, as is well known.

The freezer and fresh food compartments 16 and 18 are cooled by circulating refrigerated air therethrough which has been refrigerated as a result of being passed in heat exchange relation with a conventional evaporator 24. An evaporator fan 26 draws air across the evaporator 24 with the cooled air passing through a duct 28 behind a rear wall 30 of the freezer compartment 16 and further through a freezer compartment air inlet 32. The duct 28 is also in communication with a scoop, or passage 34, in the separator 14 to a fresh food compartment upper air inlet 36. The inlet 36, such as a conventional vent, includes suitable openings for enabling refrigerated air to be delivered to the fresh food compartment 18. An elongated tube 38 extends diagonally from within the passage 34, downwardly and forwardly through the separator wall 14. The tube 38 terminates in a fresh food compartment lower air inlet 40, located below the lower shelf 21.

Refrigerated air that passes through the passage 34 is discharged through the air inlets 36 and 40 to circulate within the fresh food compartment and subsequently return to the evaporator compartment through a return air outlet duct, or passage, 42 located in the separator 14 at the rear of the food compartment 18, just above the lower shelf 21. A selectively positional baffle 44 overlays the outlet passage 42 and is operated by a control discussed in greater detail below to control the passage of return air from the fresh food compartment 18 to the evaporator compartment, to thus control the circulation of air in the fresh food compartment 18.

The refrigerated air in the freezer compartment 16 returns to the evaporator compartment through a freezer compartment air outlet 46 and mixes with the air returned from the fresh food compartment 18. The mixed air is drawn by the evaporator fan 26 across the evaporator 24 during a cooling unit on cycle to remove heat therefrom and recirculate the air in the compartments 16 and 18.

In addition to the evaporator 24 and the evaporator fan 26, the refrigeration apparatus includes connected components such as a compressor, a condenser, a condenser fan and a defrost heater (not shown) as is obvious to those skilled in the art.

The desired temperature for the fresh food compartment 18 is user-selectable by means of fresh food temperature set point control knob 48 mounted to a control panel 50 in the top portion of the fresh food compartment 18. The cooling of the fresh food compartment is controlled in accordance with the actual temperature of the fresh food compartment as determined by a temperature sensor 52 which is positioned in the bottom portion of the fresh food compartment 18. Alternatively, the sensor 52 could be positioned at other locations within the cabinet. The illustrated position is advantageous in conjunction with the outlet baffle 44 for preventing backflow of freezer air during unit off times.

Figure 3:
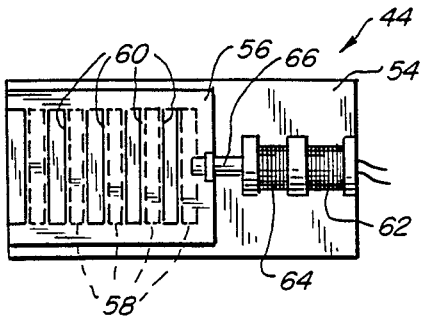
FIG. 3 illustrates the air outlet baffle of FIGS. 1 and 2.

The controllable baffle 44 is illustrated in greater detail in FIG. 3 which illustrates the baffle in the closed position wherein the baffle prevents air from returning through the passage 42 into the evaporator compartment. Such a baffle is particularly described in Janke, U.S. Pat. No. 4,682,474, owned by the assignee of the present invention, the specification of which is incorporated by reference herein.

The baffle 44 includes a fixed plate 54 and a movable plate 56. The movable plate 56 is slidably affixed to the fixed plate 54 permitting straight line reciprocal motion of the movable plate 56 with respect to the fixed plate 54. The fixed plate 54 includes a plurality of spaced elongated apertures 58 through which air may pass. The movable plate 56 includes a plurality of corresponding spaced elongated apertures 60.

A first, or open, solenoid coil 62 and an oppositely wound second, or closed, coil 64 are fixedly secured to the fixed plate 54. An elongated iron core, or armature, 66 is affixed to the movable plate 56. The armature 66 is axially movable according to energization of the coils 62 or 64.

The baffle 44 is encased in a housing, not shown, which overlays the passage 42. The baffle 44 directs air flowing through the apertures 58 and 60 into the passage 42. In the closed position of FIG. 2, the apertures 58 and 60 are in disaligned relationship, thereby substantially preventing air flow from the fresh food compartment 18 to the evaporator compartment. In the open position, not shown, the apertures 58 and 60 are substantially aligned, permitting return air flow from the fresh food compartment 18.

In operation, when the first solenoid coil 62 is energized, electrical current through the coil 62 creates a magnetic field which causes the armature 66, and thus also the movable plate 56, to move in a direction towards the coil 62 setting the baffle 44 to the open position. Conversely, when the second solenoid coil 64 is energized, the current therein develops a magnetic field which causes the armature 66, and thus the movable plate 56, to move in a direction towards the coil 64 thus setting the baffle 44 to the closed position, as shown in FIG. 3.

Figure 4:
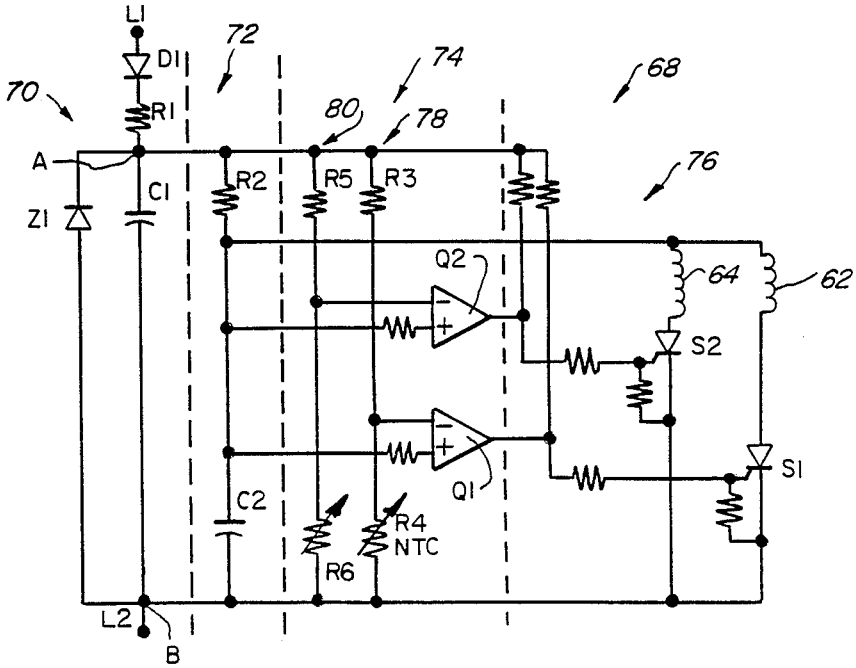
FIG. 4 is an electrical schematic of a control circuit for the baffle of FIG. 3.

An electrical schematic of a control circuit 68 for operating the coils 62 and 64 is illustrated in FIG. 4. The control circuit 68 includes a power supply circuit 70, a timer circuit 72, a bridge circuit 74 and a driver circuit 76.

The power supply circuit 70 includes a diode D1, a resistor R1 and a capacitor C1 serially coupled between the terminals L1 and L2 of a power source. A Zener diode Z1 is connected in parallel with the capacitor C1. The power supply circuit 70 is operable to convert standard 120 volt AC Supply connected across terminals L1 and L2 to a DC voltage present between terminals A and B.

The timer circuit 72 includes a resistor R2 and a capacitor C2 series connected between the power supply terminals A and B. In the illustrated embodiment the resistor R2 comprises a 60K resistor, and the capacitor C2 comprises a 1000 microfarad capacitor, providing illustratively, approximately a one minute charge time across the capacitor C2. The capacitor C2 generates an analog voltage representing a cycle time determined by the charge time of the capacitor C2.

The bridge circuit 74 includes first and second voltage dividers 78 and 80. The first voltage divider circuit 78 has a fixed resistor R3 and a variable resistor R4 connected between the power supply terminals A and B to an inverting input of a first comparator Q1. The second voltage divider 80 has a fixed resistor R5 and a variable resistor R6 coupled between the power supply terminals A and B to an inverting input of a second comparator Q2. The non-inverting input of each comparator Q1 and Q2 is connected to the capacitor C2. Each voltage divide circuit 78 and 80 generates an analog voltage represented by a voltage across the respective variable resistors R4 and R6. Each comparator Q1 and Q2 has an output which assumes a high voltage state if the voltage present at its non-inverting input exceeds a voltage present at its inverting input. Conversely, the output of each comparator Q1 and Q2 assume a low voltage state if a voltage at its inverting input exceeds a voltage at its non-inverting input.

The variable resistor R4 represents a variable resistance output of the temperature sensor 52 previously described with reference to FIG. 2. In the preferred embodiment, the temperature sensor 52 is a negative temperature coefficient (NTC) sensing thermistor which provides a resistance inversely proportional to the sensed temperature. The variable resistor R6 is a user-adjustable potentiometer which is mechanically linked to the set point control knob 48. The resistance value across the resistor R6 is directly proportional to the desired temperature value selectioned by the user.

The driver circuit 76 includes the first and second solenoid coils 62 and 64, each having one end connected to the capacitor C2. Connected between the other end of each coil 62 and 64 and the power supply terminal B is a silicon controlled rectifier switch S1 and S2, respectively. The output of each comparator Q1 and Q2 is respectively coupled through appropriate resistive elements to the gate of its associated SCR S1 and S2 for controllably switching the same.

As discussed above, the capacitor C2 of the time circuit 72 is continually charged by the DC voltage present between the terminals A and B. The voltage across the capacitor is present at the non-inverting input of each of the comparator's Q1 and Q2. The voltage present at the inverting input of the first comparator Q1 represents the actual fresh food compartment temperature, as developed across the variable resistor R4 associated with the sensor 52, see FIG. 2. As is characteristic with an NTC thermistor, as the temperature increases, the resistance decreases, and vice versa. The voltage present at the inverting input of the second comparator Q2 is the voltage across the variable resistor R6, representing the desired fresh food compartment temperature, as set by the control knob 48.

As is apparent from the above, if the actual fresh food compartment temperature is higher than the desired temperature, indicating that additional cooling is desired, the voltage present at the inverting input of the first comparator Q1 is lower than the voltage present at the inverting input of the second comparator Q2. As the charge on the capacitor C2 increases, the voltage at the non-inverting input of both comparators Q1 and Q2 similarly increases. Subsequently, because the voltage at the inverting input of the first comparator Q1 is lower than that of the second comparator Q2, the output of the first comparator Q1 assumes a high voltage state before the second comparator Q2, i.e., the capacitor voltage exceeds the voltage across the variable resistor R4. Resultantly, the first SCR switch S1 is gated causing the first solenoid coil 62 to be in series with the capacitor C2. The charge on the capacitor C2 is dumped through the first solenoid 62, thereby energizing same to move the movable plate 56 to the open position. The dumping of the capacitor charge C2 results in the voltage across the capacitor C2 dropping substantially equal to zero. The discharging causes the voltage at the non-inverting input of both comparators Q1 and Q2 to decrease, resulting in the output of both comparators Q1 and Q2 being in the low voltage state. As the capacitor C2 voltage approaches zero, the switch S1 shuts off since the current through the switch S1 and coil 62 drops below the level required to keep the switch S1 in the state of conduction. Resultantly, the first solenoid coil 62 is energized only momentarily to move the baffle 44 to the open position.

The above described cycle repeats itself with the first solenoid coil 62 becoming energized once each cycle as long as the sensed temperature is greater than the desired temperature.

If the sensed temperature is lower than the desired temperature, indicating that fresh food compartment needs no additional cooling time, then the resistance, and voltage, across the NTC thermistor R4 is greater than that of the potentiometer R6. Accordingly, the baffle is operated to assume the closed position. Particularly, during each cycle the capacitor C2 charges, as above, except that the output of the second comparator Q2 assumes a high voltage state before that of the first comparator Q1, owing to the lower voltage at the inverting input of the second comparator Q2. With the output of the second comparator Q2 at a high voltage state, the second SCR Switch S2 is gated placing the second coil 64 directly across the capacitor C2, momentarily energizing same, as above. Resultantly, the movable plate 56 is moved in the closed position to prevent the return of air from the fresh food compartment 18 to the evaporator compartment.

As long as power is provided to the refrigerator 10, the baffle 44 operates in the controlled fashion as described above with the baffle being in the closed position when the fresh food compartment actual temperature is lower than its desired temperature, and the baffle 44 being in the open position when the actual temperature is greater than the desired set point temperature.

In operation, as illustrated in FIG. 1, when the baffle 44 44 is in the open position and the evaporator fan 26 is on, refrigerated air passes through the first passage 34 and the upper air inlet 36 into the fresh food compartment 18. Also, refrigerated air passes through the tube 38 in the separator wall 14 to the lower air inlet 40 to provide direct cooling of the bottom portion of the fresh food compartment, specifically at the pan 22, below the lower shelf 21. This air is returned through the outlet baffle 44 and outlet passage 42 to the evaporator 24. Subsequently, when the actual temperature drops below the desired temperature, the baffle 44 is moved to the closed position to prevent air from returning to the evaporator compartment. The closing of the baffle 44 results in the fresh food compartment 18 being under positive pressure, with the door closed, so that, for all practical purposes, no air is delivered through either of the inlets 36 and 40, and the air does not circulate within the fresh food compartment 18. As a result of the baffle 44 being positioned at the air outlet passage 42, air which flows across the baffle 44 is fresh food compartment air that is at a warmer temperature than that provided directly at the inlets 36 and 40. Resultantly, the above described problem relating to the baffle freezing after the defrost cycle is virtually eliminated.

Moreover, since the temperature sensor 52 is positioned in the bottom section of the fresh food compartment 18, near the baffle 44, the temperature of the air exiting the fresh food compartment 18 is sensed. Accordingly, during the unit off time, if the bottom of the cabinet becomes cold due to back flow of cold air from the freezer compartment 16, the baffle 44 closes to prevent back flow cooling.

Figure 5:
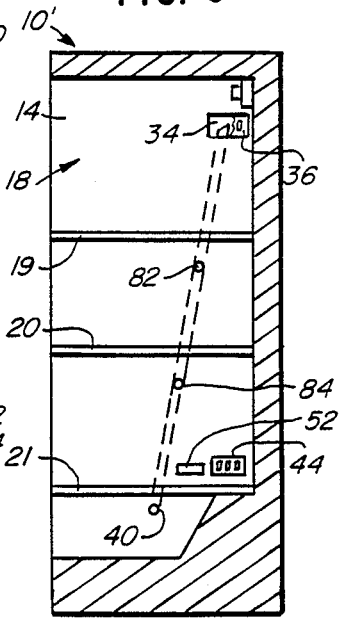
FIG. 5 is a view similar to that of FIG. 2 for an alternative embodiment of the present invention.

With reference to FIG. 5, a sectional view of a refrigeration apparatus 10' according to an alternative embodiment of the invention is illustrated. In the refrigeration apparatus 10' like reference numerals reference like elements as from the refrigeration apparatus 10 of FIGS. 1–4. The refrigeration apparatus 10' in addition to the air inlets 36 and 40 includes additional vertically spaced air inlets 82 and 84 in communication with the separator wall tube 38 for directly providing refrigerated air at preselected vertical positions between the respective pairs of adjacent shelves 19 and 20, and 20 and 21. Such inlets 82 and 84, in conjunction with the upper and lower inlets 36 and 40, respectively, provide for zone cooling whereby refrigerated air is directed to each zone, the zone being defined by the space between adjacent lower shelves, as illustrated.

Thus, the invention broadly comprehends an air circulation system for minimizing freeze up problems for an air flow baffle and for preventing overcooling under back flow conditions.

The foregoing disclosure of the preferred embodiments is illustrative of the broad inventive concepts comprehended by the invention.

We claim:

1. A refrigeration apparatus comprising:

a cabinet having a freezer compartment and a fresh food compartment to be cooled by refrigerated air, and a divider wall separating said compartments;

means for providing refrigerated air to cool said freezer compartment;

means for delivering air from said air providing means to said fresh food compartment comprising a first passage through said divider wall opening to a first air inlet and an elongated conduit extending from within said first passage through said divider wall and opening to a second air inlet;

means for returning air from said fresh food compartment to said air providing means comprising a second passage through said divider wall;

means associated with said air providing means for circulating refrigerated air from said air providing means through said delivering means to said fresh food compartment and from said fresh food compartment through said returning means to said air providing means; and means for controlling the circulation of refrigerated air through said fresh food compartment by selectively opening and closing said air outlet.

2. The refrigeration apparatus of claim 1 wherein said controlling means comprises a controllable baffle mounted at said air outlet for selectively opening or closing said air outlet to respectively allow or prevent movement of air through said fresh food compartment.

3. The refrigeration apparatus of claim 1 wherein said fresh food compartment includes a top portion and a bottom portion and said first air inlet is located at said top portion and said air outlet and said second air inlet are located at said bottom portion.

4. In a side-by-side refrigerator/freezer having means for providing refrigerated air, a fan providing flow of refrigerated air, and a cabinet provided with a divider wall defining a freezer compartment and a fresh food compartment to be cooled by the refrigerated air, an air circulation system comprising:

first air inlet means for providing a first air flow passage through said divider wall, through which air flows from said air providing means to a top portion of said fresh food compartment;

second air inlet means for providing a second air flow passage extending from said first air flow passage downwardly through said divider wall, through which air flows from said air providing means to a bottom portion of said fresh food compartment;

air outlet means for providing a return air flow passage, through which air flows from said fresh food compartment to said air providing means;

baffle means mounted at said air outlet means for selectively opening or closing said return air flow passage; and control means operatively associated with said baffle means for controlling said baffle means to selectively open or close said return air flow passage to respectively allow or prevent movement of air through said fresh food compartment.

5. The air circulation system of claim 4 wherein said control means includes means for sensing the temperature of said fresh food compartment, means for preselecting a desired fresh food compartment temperature, and circuit means coupled to said sensing means, said preselecting means and said baffle means for controlling said baffle means to open said return air flow passage if said sensed temperature is above said preselected temperature and to close said second air flow passage if said sensed temperature is below said desired temperature.

6. The air circulation system of claim 5 wherein said circuit means includes first and second solenoids operatively associated with said baffle means for operating said baffle means to respectively open or close said air flow passage as controlled by said circuit means.

7. The air circulation system of claim 4 wherein said air outlet means includes an air outlet passage positioned at the bottom portion of said fresh food compartment.

8. In a refrigeration apparatus having means for providing refrigerated air, a cabinet having a divider wall defining a freezer compartment and a fresh food compartment to be cooled by air delivered thereto from the air providing means, an air circulation system comprising:

air flow means disposed in said freezer compartment for causing flow of said refrigerated air;

first passage means through said divider wall in communication with said air flow means and said fresh food compartment and defining first and second compartment air inlets, one of said inlets being located at a top portion of said fresh food compartment, and the other of said inlets being at a bottom portion of said fresh food compartment, for delivering refrigerated air from said air providing means to said fresh food compartment;

second passage means through said divider wall in communication with said air flow means and said fresh food compartment and defining an air outlet for returning air from the bottom portion of said fresh food compartment to said air providing means;

baffle means for selectively opening or closing said second passage means;

means for sensing the temperature of the bottom portion of said fresh food compartment;

means for preselecting a desired fresh food compartment temperature; and control means coupled to said sensing means and said preselecting means and operatively associated with said baffle means for operating said baffle means to selectively open or close said second passage means responsive to the sensed temperature and the desired temperature.

9. The air circulation system of claim 8 wherein said control means includes circuit means coupled to said sensing means, said preselecting means and said baffle means for controlling said baffle means to open said second air flow passage if said sensed temperature is above said preselected temperature and to close said second air flow passage if said sensed temperature is below said desired temperature.

10. The air circulation system of claim 9 wherein said circuit means includes first and second solenoids operatively associated with said baffle means for operating said baffle means to respectively open or close said air flow passage as controlled by said circuit means.

11. The air circulation system of claim 8 wherein said control means includes first and second solenoids for operating said baffle means to respectively open or close said second passage means, and further comprising control circuit means coupled to said first and second solenoid, said sensing means and said preselecting means for periodically energizing either said first or said second solenoid to selectively open or close said second passage means.

12. The air circulation system of claim 11 wherein said first solenoid is periodically energized if said sensed temperature is greater than said desired temperature, and said second solenoid is periodically energized if said sensed temperature is less than said desired temperature.

13. A refrigeration apparatus comprising:

a cabinet having a vertical divider wall defining a freezer compartment and a fresh food compartment to be cooled;

an evaporator associated with a duct in the rear of said freezer compartment operable to provide refrigerated air;

an evaporator fan operatively associated with said evaporator to cause refrigerated air to flow thereby;

inlet passage means through said divider wall in communication with said fan and said fresh food compartment and defining a plurality of compartment air inlets, each of said inlets being vertically spaced in said fresh food compartment relative to the other of said inlets;

outlet passage means through said divider wall in communication with said fan and said fresh food compartment and defining an air outlet for returning air from a bottom portion of said fresh food compartment to said fan;

baffle means for selectively opening or closing said second passage means;

means for sensing the actual temperature at the bottom portion of said fresh food compartment;

means for preselecting a desired fresh food compartment temperature; and control means coupled to said sensing means and said preselecting means and operatively associated with said baffle means for operating said baffle means to selectively open or close said second passage means responsive to the sensed temperature being respectively greater or less than said desired temperature.

14. The refrigeration apparatus of claim 13 wherein said baffle means comprises a fixed plate having an aperture therein, a movable plate having aperture therein, and solenoid means for controllably moving the movable plate relative to the fixed plate so that said apertures are either in substantial alignment to open said second passage means, or substantial disalignment to close said second passage means.

15. The refrigeration apparatus of claim 14 wherein said solenoid means comprises first and second solenoid coils which are selectively energized to move said movable plate relative to said fixed plate to respectively open or close said second passage means.

16. The refrigeration apparatus of claim 13 wherein said sensing means generates a voltage corresponding to the sensed temperature, said preselecting means generates a voltage corresponding to a desired temperature, and said control means includes timer means for repeatedly generating a voltage representing a cycle time, circuit means for comparing the voltage generated by said temperature sensing means with the voltage generating by said timer means, and comparing the voltage generated by said preselecting means with the voltage generated by said timer means, means for selectively energizing either said first or said second solenoid coil once during each generated cycle time, and means for resetting said timer means to start a new cycle when said timer means voltage exceeds either said preselecting means voltage or said temperature sensing means voltage.

* * * * *